US005899681A

United States Patent [19]

Maughan

[11] Patent Number: 5,899,681

[45] Date of Patent: May 4, 1999

[54] ATMOSPHERIC GAS BURNER ASSEMBLY FOR IMPROVED FLAME RETENTION AND STABILITY

[75] Inventor: James Rollins Maughan, Scotia, N.Y.

[73] Assignee: General Electric Company, Schenectady, N.Y.

[21] Appl. No.: 08/986,203

[22] Filed: Dec. 5, 1997

[51] Int. Cl.[6] ..... F23D 14/06; F23D 14/58

[52] U.S. Cl. ..... 431/8; 431/286; 431/349

[58] Field of Search ..... 431/286, 191, 431/193, 194, 349, 8, 2

[56] References Cited

U.S. PATENT DOCUMENTS

| | | | |
|---|---|---|---|
| 2,220,247 | 11/1940 | Kochendorfer et al. | 158/116 |
| 2,588,895 | 3/1952 | Taverner | 431/349 |
| 2,854,069 | 9/1958 | Jensen | 431/286 |
| 3,796,535 | 3/1974 | De Gouville | 431/349 |
| 4,757,801 | 7/1988 | De Gouville et al. | 126/39 H |
| 5,104,311 | 4/1992 | Maughan et al. | 431/75 |
| 5,133,658 | 7/1992 | De Gouville et al. | 431/349 |
| 5,246,365 | 9/1993 | Himmel et al. | 431/263 |
| 5,328,357 | 7/1994 | Riehl | 431/266 |
| 5,408,984 | 4/1995 | Maughan | 126/39 E |
| 5,464,004 | 11/1995 | Maughan | 126/39 E |
| 5,488,942 | 2/1996 | Maughan | 126/39 E |
| 5,494,027 | 2/1996 | Maughan | 126/214 D |

FOREIGN PATENT DOCUMENTS

| | | | |
|---|---|---|---|
| 1360192 | 3/1964 | France | 431/286 |

*Primary Examiner*—Carl D. Price

*Attorney, Agent, or Firm*—Patrick K. Patnode; Marvin Snyder

[57] ABSTRACT

A gas burner assembly for connection to a source of gas comprises a burner body having a sidewall and a main gas conduit. The main gas conduit has a burner throat and the sidewall has an inner surface, an outer surface and a top surface. A plurality of primary burner ports are disposed within the sidewall dividing the sidewall into a plurality of sidewall islands. A burner cap is removeably disposed on the sidewall. A plurality of paired opposing ridges are disposed on the top surface of the sidewall wherein a single pair of opposing ridges are disposed on a respective sidewall island so as to define a plurality of carryover slots between the opposing ridges, the top surface and the burner cap. Each carryover slot has an inlet and an outlet. The paired ridges comprise a radial taper that narrows from a point adjacent the inner surface of the sidewall to a point adjacent the outer surface of the sidewall such that the flow area at the inlet of the carryover slot has a value that is less than the value of the flow area at the outlet of the carryover slot so as to reduce fuel-air mixture velocity and produce a low velocity, stable carryover flame that reduces the tendency of the main flame to lift.

14 Claims, 4 Drawing Sheets

ATMOSPHERIC GAS BURNER ASSEMBLY FOR IMPROVED FLAME RETENTION AND STABILITY

BACKGROUND OF THE INVENTION

This application relates to atmospheric gas burners, and in particular relates to improvements in gas burner flame retention.

Atmospheric gas burners are commonly used as surface units in household gas cooking appliances. A significant factor in the performance of gas burners is the input rate of the fuel-air mixture within the burner. The maximum fuel-air input rate is typically determined by the flame stability limit about the periphery of the burner. At high input rates and consequently high fuel-air velocities, the flames are not stably attached to the burner ports. The flames burn in an unstable, detached manner typically called lifting. Lifting is generally accompanied by objectionable noise and increased carbon monoxide emissions.

Conventional burners employ smaller burner ports, termed retention flame ports, adjacent to or below the main flame ports to reduce the tendency of the main flame to lift. The velocity of the fuel-air mixture through the smaller retention port is generally lower then the velocity through the main flame ports, reducing the tendency of the retention flame to lift and resulting in improved stability of the main flames.

The retention flames emanating from each respective retention flame port also assist in carrying flame from port to port during an ignition or re-ignition. In current burners, however, retention flames are only partially effective in controlling lifting and can interfere with the flow of secondary combustion air towards the main burner ports, resulting in higher carbon monoxide emissions.

Accordingly, there is a need for an atmospheric gas burner which is better able to establish flame about the periphery of the burner during ignition or re-ignition. Additionally, there is a need for an atmospheric gas burner having a reduced tendency for flames to lift from the burner ports, especially at high fuel-air input rates, and for reduced carbon monoxide emissions.

SUMMARY OF THE INVENTION

A gas burner assembly for connection to a source of gas comprises a burner body having a sidewall and a main gas conduit. The main gas conduit has a burner throat and the sidewall has an inner surface, an outer surface and a top surface. A plurality of primary burner ports are disposed within the sidewall dividing the sidewall into a plurality of sidewall islands. A burner cap is removeably disposed on the sidewall. A plurality of paired opposing ridges are disposed on the top surface of the sidewall wherein a single pair of opposing ridges are disposed on a respective sidewall island so as to define a plurality of carryover slots between the opposing ridges, the top surface and the burner cap. Each carryover slot has an inlet and an outlet. The paired ridges comprise a radial taper that narrows from a point adjacent the inner surface of the sidewall to a point adjacent the outer surface of the sidewall such that the flow area at the inlet of the carryover slot has a value that is less than the value of the flow area at the outlet of the carryover slot so as to reduce fuel-air mixture velocity and produce a low velocity, stable carryover flame that reduces the tendency of the main flame to lift.

DETAILED DESCRIPTION OF THE INVENTION

Figure 1:
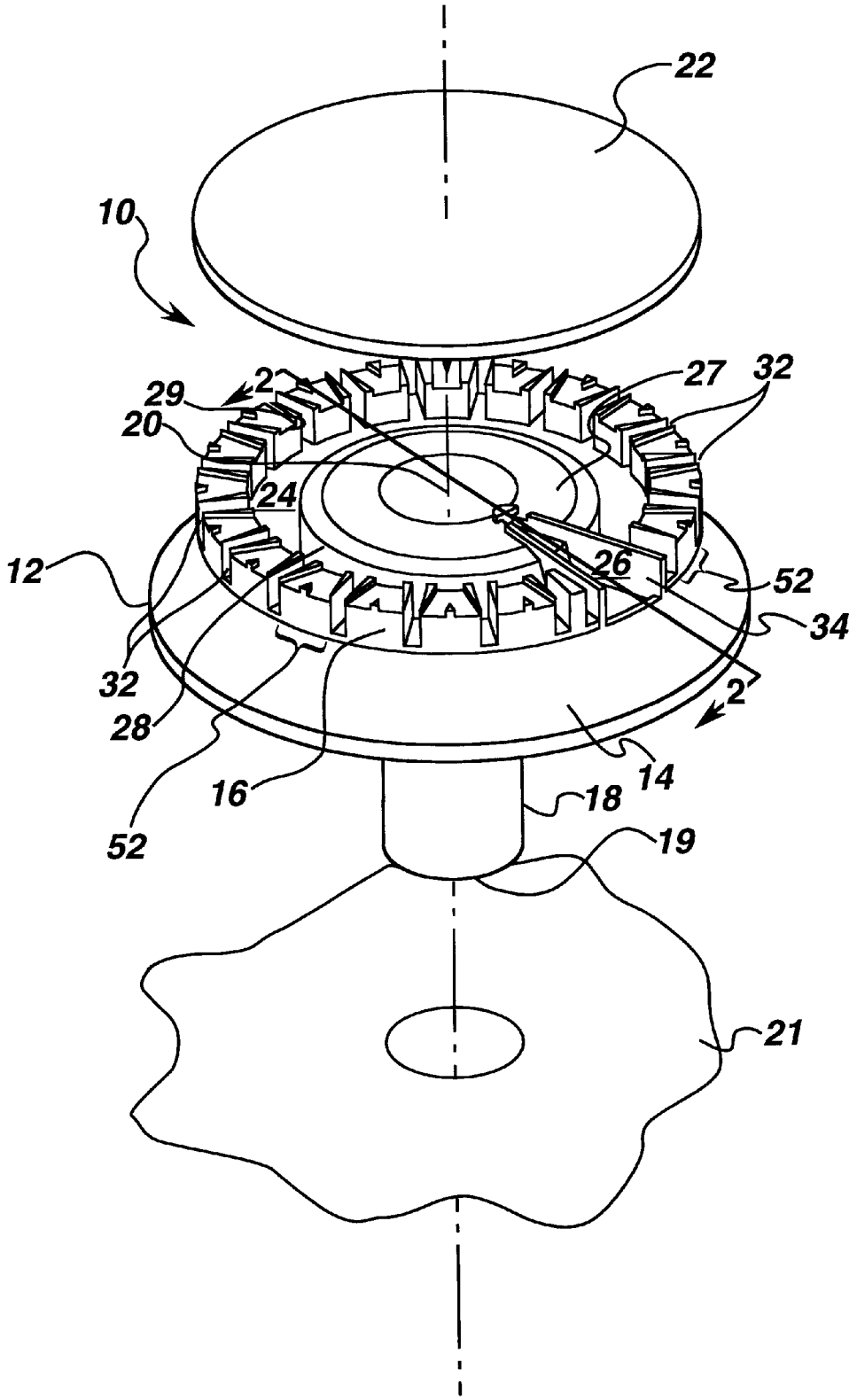
FIG. 1 is an exploded perspective view of a gas burner assembly in accordance with one embodiment of the instant invention.
Figure 2:
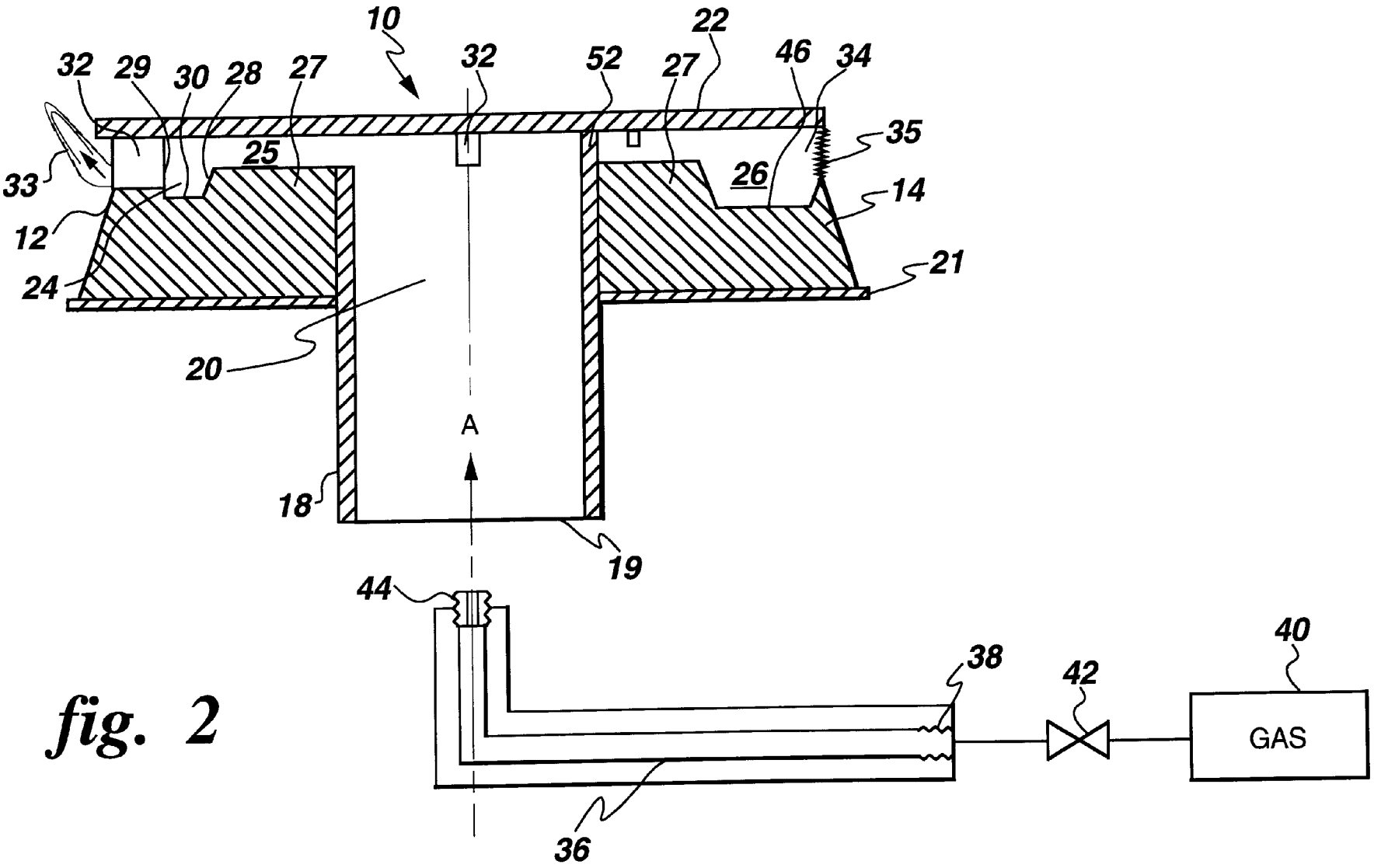
FIG. 2 is a cross-sectional plan view through line 2—2 of FIG. 1, in accordance with one embodiment of the instant invention.

An atmospheric gas burner assembly 10 includes a burner body 12 having a frustrum-shaped solid base portion 14 and a cylindrical sidewall 16 (FIG. 1) extending axially from the periphery of base portion 14, as shown in the illustrative embodiment of FIGS. 1 and 2. A main gas conduit 18 having an entry area 19 and a burner throat region 20 is open to the exterior of burner body 12 and defines a passage which extends axially through the center of burner body 12 to provide fuel/air flow along path "A" (FIG. 2) to burner assembly 10. As used herein, the term "gas" refers to a combustible gas or gaseous fuel-air mixture.

Burner assembly 10 is mounted, in a known manner, on a support surface 21 (FIG. 1) of a gas cooking appliance such as a range or a cooktop. A cap 22 is disposed over the top of burner body 12, defining therebetween an annular main fuel chamber 24 and annular diffuser region 25 (FIG. 2). A toroidal-shaped upper portion 27 of burner body 12, immediately bordering burner throat 20, in combination with cap 22 defines annular diffuser region 25 therebetween. Cap 22 can be fixedly attached to sidewall 16 (FIG. 1) or other designated attachment point or can simply rest on sidewall 16 for easy removal. While one type of burner is described and illustrated, the instant invention is applicable to other types of burners, such as stamped aluminum burners and separately mounted orifice burners.

Annular main fuel chamber 24 is defined by an outer surface 28 of toroidal shaped upper surface 27, an inner surface 29 of sidewall 16, an upper surface 30 (FIG. 2) of base portion 14, and cap 22. A plurality of primary burner ports 32 are disposed in sidewall 16 (FIG. 1) of burner body 12 so as to provide a path to allow fluid communication with main fuel chamber 24, each primary burner port 32 being adapted to support a respective main flame 33 (FIG. 2). Primary burner ports 32 are typically, although not necessarily, evenly spaced about sidewall 16. As used herein, the term "port" refers to an aperture of any shape from which a flame may be supported.

A gas feed conduit 36 (FIG. 2) comprises a coupling 38 disposed on one end for connection to a gas source 40 via a valve 42 (shown schematically in FIG. 2). Valve 42 is controlled in a known manner by a corresponding control knob on the gas cooking appliance to regulate the flow of gas from gas source 40 to gas feed conduit 36. The other end of gas feed conduit 36 is provided with an injection orifice 44. Injection orifice 44 is aligned with main gas conduit 18 so that fuel, discharged from injection orifice 44, and entrained air are supplied to main fuel chamber 24 and stability chamber 26 via main gas conduit 18 along path "A" of FIG. 2.

As shown in FIGS. 1 and 2, burner assembly 10 may further include a stability chamber 26 that is substantially isolated from main fuel chamber 24. Stability chamber 26 may comprise, for example, a stability chamber as discussed in copending, commonly assigned, application Ser. No.

08/774,976, filed Dec. 26, 1996, entitled "An Atmospheric Gas Burner Assembly for Improved Flame Stability," which application is incorporated herein by reference.

At least one simmer flame port 34 is disposed in sidewall 16 (FIG. 1) of burner body 12 so as to provide a path to allow fluid communication with stability chamber 26. Simmer flame port 34 is adjacent to primary burner ports 32 to provide a re-ignition source to primary burner ports 32 if flameout occurs.

Figure 3:
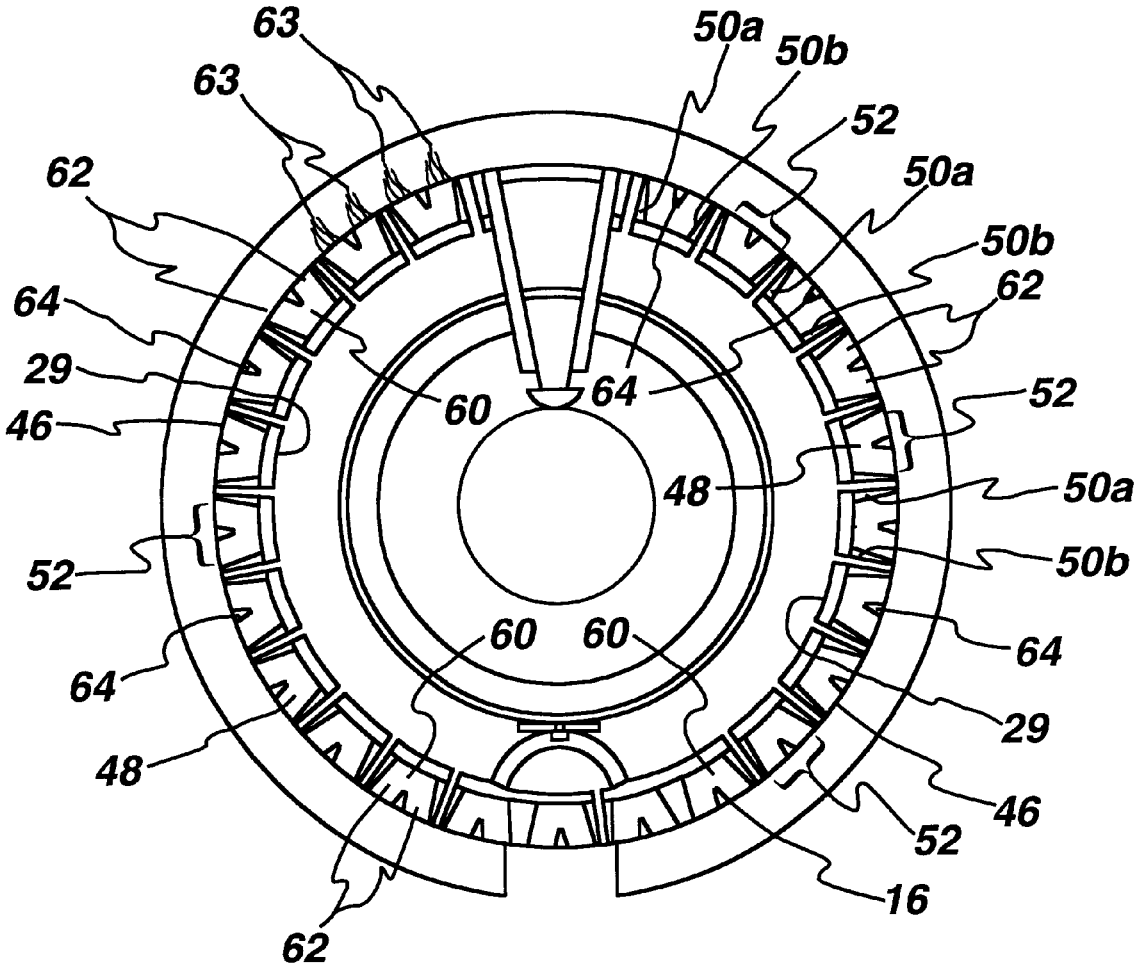
FIG. 3 is a top plan view of a gas burner assembly in accordance with one embodiment of the instant invention.

In accordance with one embodiment of the instant invention, sidewall 16 comprises inner surface 29, an outer surface 46 and a top surface 48, as shown in FIG. 3. A plurality of paired, opposing ridges 50*a* and 50*b* are disposed upon top surface 48. Each ridge 50*a*, 50*b* extends radially from inner surface 29 of sidewall 16 to outer surface 46 of sidewall 16 and protrudes above top surface 48 (best shown in FIG. 4).

Each pair of opposing ridges 50*a* and 50*b* are disposed on a respective sidewall island 52. Sidewall island 52, as used herein, is defined as the portion of sidewall 16 disposed between adjacent primary burner ports 32 (FIG. 1). Each pair of ridges 50*a*, 50*b* are disposed on top surface 48 of sidewall 16 such that an outer surface 54 of each respective ridge 50*a* and 50*b* is disposed contiguously with an inner wall 56 of a respective primary burner port 32 so as to form a faired surface therewith.

Figure 4:
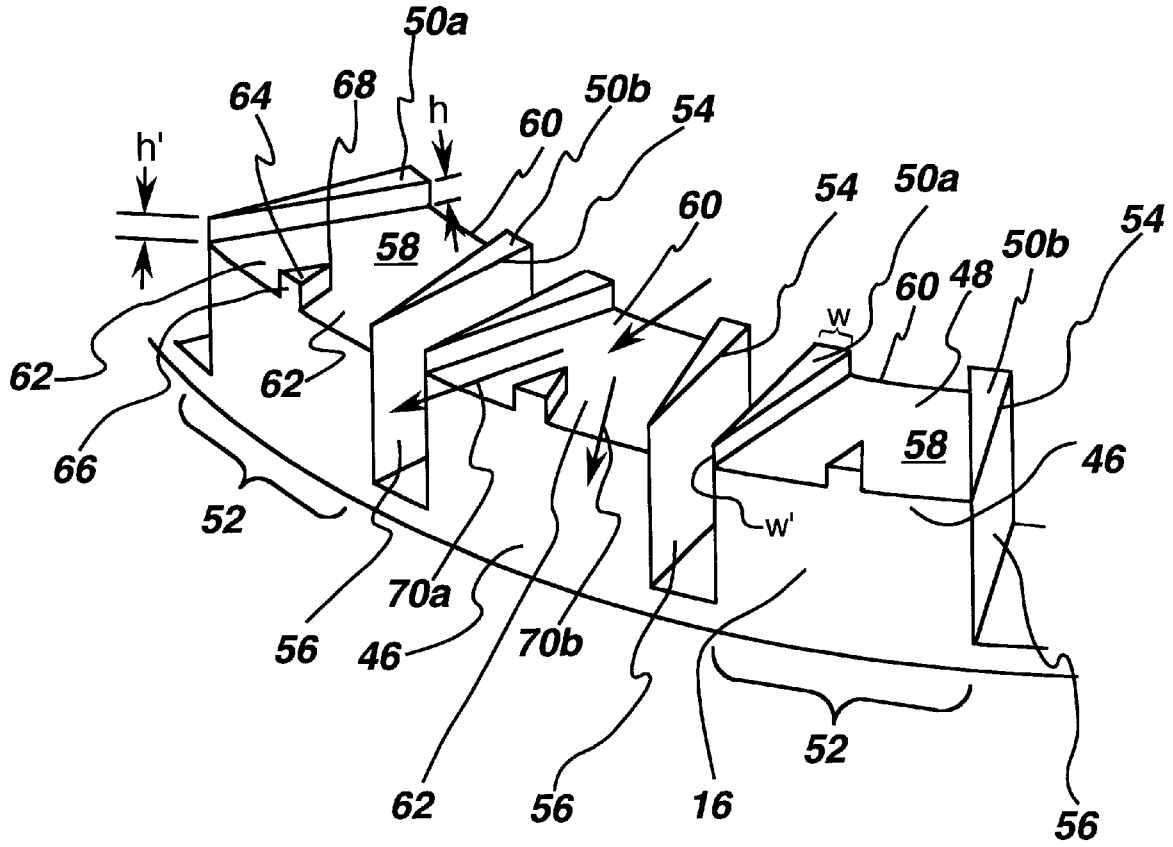
FIG. 4 is an exploded sectional perspective view of a portion of a gas burner assembly in accordance with one embodiment of the instant invention.

As shown best in FIG. 4, ridges 50*a* and 50*b* combine with top surface 48 and cap 22 (cap 22 removed in FIG. 4) to define a plurality of carryover slots 58. Each carryover slot 58 includes an inlet 60 adjacent inner surface 29 of sidewall 16 and an outlet 62 adjacent outer surface 46 of sidewall 16, such that each carryover slot 58 is capable of supporting a carryover flame 63 (FIG. 3).

Each pair of opposing ridges 50*a* and 50*b* (FIG. 4) comprise a radial taper that narrows from inner surface 29 of sidewall 16 to outer surface 46 of sidewall 16. Accordingly, the flow area through inlet 60 of carryover slot 58 is a value that is less than the value of the flow area through outlet 62 of carryover slot 58. Due to this outwardly widening design of carryover slot 58, the flow velocity of the fuel-air mixture entering carryover slot 58 is reduced as the flow travels from inlet 60 towards outlet 62. The flow velocity is further reduced by friction between the fuel-air mixture and burner cap 22. This reduction in flow velocity improves the flame-holding characteristics of each carryover slot 58.

In one embodiment of the instant invention, ridges 50*a* and 50*b* have a height (h) in the range between about 0.01 inches (0.254 mm) to about 0.04 inches (1.016 mm) at an end adjacent inner surface 29 of sidewall 16 and a height (h') in the range between about 0.01 inches (0.254 mm) to about 0.04 inches (1.016 mm) at an end adjacent outer surface 46 of sidewall 16. In another embodiment of the instant invention, ridges 50*a* and 50*b* have a width (w) in the range between about 0.01 inches (0.254 mm) to about 0.10 inches (2.54 mm) at an end adjacent inner surface 29 of sidewall 16 and a width (w') in the range between about 0.01 inches (0.254 mm) to about 0.10 inches (2.54 mm) at an end adjacent outer surface 46 of sidewall 16.

In another embodiment of the instant invention, ridges 50*a* and 50*b* have a height (h) in the range between about 0.026 inches (0.66 mm) to about 0.031 inches (0.7874 mm) at an end adjacent inner surface 29 of sidewall 16 and a height (h') in the range between 0.011 inches (0.279 mm) to about 0.017 inches (0.432 mm) at an end adjacent outer surface 46 of sidewall 16. This formation has a ridge 50*a*, 50*b* declivity from the end adjacent inner surface 29 of sidewall 16 towards the end adjacent outer surface 46 of sidewall 16, further reducing the velocity of the fuel-air mixture entering a respective carryover slot 58. In another embodiment of the instant invention, ridges 50*a* and 50*b* have a width (w) in the range between about 0.052 inches (1.321 mm) to about 0.067 inches (1.70 mm) at an end adjacent inner surface 29 of sidewall 16 and a width (w') in the range between about 0.027 inches (0.686 mm) to about 0.029 inches (0.737 mm) at an end adjacent outer surface 46 of sidewall 16. Below, Table 1 gives several examples of gas burner assembly 10 design parameters.

TABLE 1

| Burner Design | Kbtu/hr | h' | h | w' | w |
|---|---|---|---|---|---|
| Burner 1 | 12–13 | 0.014 in | 0.027 in | 0.028 in | 0.053 in |
| Burner 2 | 9.5 | 0.016 in | 0.028 in | 0.028 in | 0.066 in |

In another embodiment of the instant invention, a plurality of flow dividing wedges 64 are disposed on top surface 48 of sidewall 16. In particular, a single flow dividing wedge 64 is disposed on a respective sidewall island 52. Each flow dividing wedge 64 comprises an outer base section 66 that is contiguous with outer surface 46 of sidewall 16 so as to create a faired surface therewith. Each flow dividing wedge 64 further comprises a tip portion 68 that extends within each carryover slot 58 so as to displace the flow of the fuel-air mixture from the center of outlet 62 into two separate outwardly directed streams of flow 70*a* and 70*b*. This formation forces the carryover slot flows 70*a* and 70*b* into the adjacent main flames 33 (FIG. 2), improving the ability of burner assembly 10 to prevent lifting and improves the ignition and re-ignition characteristics of burner assembly 10. In addition, this formation prevents a respective carryover flame 63 from completely filling the perimeter of gas burner assembly 10 between primary burner ports 32 and allows adequate secondary air to rise between adjacent main burner flames 33 resulting in a reduction of carbon monoxide emissions.

Typically, although not necessarily, flow dividing wedge 64 is centered on each respective sidewall island 52 so as to displace substantially equal streams of flow 70*a* and 70*b* between flow dividing wedge 64 and ridges 50*a* and 50*b*.

In operation, a control knob on the gas cooking appliance which corresponds to the desired gas burner assembly 10 is manipulated, thereby causing valve 42 (FIG. 2) to provide fuel to gas feed conduit 36. The fuel is discharged from injection orifice 44 and primary air is entrained to support combustion. The fuel-air mixture enters entry area 19 of main gas conduit 18 and flows along path "A" to burner throat 20 through annular diffuser region 25 to main fuel chamber 24, which main fuel chamber 24 supplies the fuel-air mixture to primary burner ports 32 for combustion by main flames 33.

Accordingly, the flow of the fuel-air mixture enters each carryover slot 58 for combustion. The resulting carryover flames 63 are directed by the respective flow dividing wedge 64 towards primary burner ports 32 that immediately border that respective carryover slot 58. (i.e., the two primary burner ports 32 defining that respective sidewall island 52.)

As discussed above, the velocity of the fuel-air mixture entering each carryover slot 58 is reduced so as to produce lower velocity, stable carryover flames 63 (FIG. 1). Since the velocity of each carryover flame 63 is comparatively low, each carryover flame 63 is less susceptible to lifting. Additionally, the two divergent flows of fuel air mixture 70*a* and 70*b* displaced by flow dividing wedge 64 are directed into the root portion of the two immediately adjacent main flames 33. The purpose of this configuration is twofold. First, because a portion of each carryover flame 63 is directed at the root of each main flame 33 of the immediately adjacent primary burner ports 34, carryover slots 58 provide a continuous ignition source for each respective main flame 33. Second, because carryover flames 63 comprise a relatively low velocity flame and are directed by flow diving wedge 64 into the root portion of the adjacent main flames 33, the carryover flames are entrained within main flame 33. This entrainment lowers the overall velocity of each main flame 33 and necessarily reduces the tendency for each main flame 33 to lift.

While only certain features of the invention have been illustrated and described herein, many modifications and changes will occur to those skilled in the art. It is, therefore, to be understood that the appended claims are intended to cover all such modifications and changes as fall within the true spirit of the invention.

We claim:

1. A method for improved flame retention and stability within a gas burner assembly comprising the steps of:

directing a fuel-air mixture through a plurality of outwardly widening carryover slots disposed on each of a plurality of sidewall islands so as to reduce at least two velocity of said mixture creating a stable carryover flame; and displacing portions of said carryover flame such that a portion of said carryover flame is directed into a root portion of the immediately adjacent main flames to provide a continuous ignition source for said main flames and to lower the overall velocity of said main flames so as to reduce lifting thereof.

2. A gas burner assembly for connection to a source of gas, said gas burner assembly comprising:

a burner body having a sidewall and a main gas conduit, said sidewall having an inner surface, an outer surface and a top surface;

a plurality of primary burner ports disposed within said sidewall dividing said sidewall into a plurality of sidewall islands;

a burner cap removeably disposed on said sidewall; and a plurality of paired opposing ridges disposed on said top surface of said sidewall wherein a single pair of opposing ridges are disposed on each respective sidewall island so as to define a plurality of carryover slots between said opposing ridges said top surface and said burner cap, each carryover slot having an inlet and an outlet;

wherein said paired ridges comprise a radial taper that narrows from a point adjacent said inner surface of said sidewall to a point adjacent said outer surface of said sidewall such that the flow area at said inlet of said carryover slot is a value that is less than the value of the flow area at said outlet of said carryover slot to reduce fuel-air mixture velocity so as to support the formation of low velocity and stable carryover flames thereat.

3. A gas burner assembly, in accordance with claim 2, wherein each pair of said paired ridges are disposed on said top surface such that an outer surface of each respective ridge is disposed contiguously with an inner wall of a respective primary burner port so as to form a faired surface therewith.

4. A gas burner assembly, in accordance with claim 2, wherein said ridges have a height (h) in the range between about 0.01 inches to about 0.04 inches at an end adjacent said inner surface of said sidewall.

5. A gas burner assembly, in accordance with claim 2, wherein said ridges have a width (w) in the range between about 0.01 inches to about 0.10 inches at an end adjacent said inner surface of said sidewall.

6. A gas burner assembly, in accordance with claim 2, wherein said ridges have a width (w') in the range between about 0.01 inches to about 0.10 inches at an end adjacent said outer surface of said sidewall.

7. A gas burner assembly, in accordance with claim 2, wherein said ridges have a height (h') in the range between about 0.01 inches to about 0.04 inches at an end adjacent said outer surface of said sidewall.

8. A gas burner assembly in accordance with claim 2, wherein said ridges have a height (h') in the range between about 0.011 inches to about 0.017 inches at an end adjacent said outer surface of said sidewall and a height (h) in the range between about 0.026 inches to about 0.031 inches at an end adjacent said inner surface of said sidewall.

9. A gas burner assembly in accordance with claim 2 wherein said ridges have a width (w) in the range between about 0.052 inches to about 0.067 inches at an end adjacent said inner surface of said sidewall and a width (w') in the range between about 0.027 inches to about 0.029 inches at an end adjacent said outer surface of said sidewall.

10. A gas burner assembly, in accordance with claim 2, further comprising a plurality of flow dividing wedges disposed on said top surface of said sidewall.

11. A gas burner assembly, in accordance with claim 10, wherein a single flow dividing wedge is disposed on a respective sidewall island.

12. A gas burner assembly, in accordance with claim 10, wherein each flow dividing wedge comprises an outer base section that is contiguous with said outer surface of said sidewall so as to create a faired surface therewith and a tip portion that extends within each carryover slot so as to displace the flow of fuel-air mixture from the center of said carryover slot into two outwardly directed streams of flow.

13. A gas burner assembly, in accordance with claim 12, wherein said outwardly directed streams of flow are entrained into an adjacent main flame so as to improve main flame stability and prevent lifting.

14. A gas burner assembly, in accordance with claim 10, wherein said flow dividing wedge is centered on said respective sidewall island so as to displace substantially equal streams of flow.

* * * * *